US012366401B2

(12) United States Patent
Ros

(10) Patent No.: US 12,366,401 B2
(45) Date of Patent: Jul. 22, 2025

(54) TRANSPORT CONTAINER

(71) Applicant: REP IP AG, Zug (CH)

(72) Inventor: Nico Ros, Riehen (CH)

(73) Assignee: REP IP AG, Zug (CH)

( * ) Notice: Subject to any disclaimer, the term of this patent is extended or adjusted under 35 U.S.C. 154(b) by 0 days.

(21) Appl. No.: 17/428,536

(22) PCT Filed: Jan. 30, 2020

(86) PCT No.: PCT/IB2020/050742

§ 371 (c)(1),
(2) Date: Aug. 4, 2021

(87) PCT Pub. No.: WO2020/161572

PCT Pub. Date: Aug. 13, 2020

(65) Prior Publication Data

US 2022/0196313 A1 Jun. 23, 2022

(30) Foreign Application Priority Data

Feb. 7, 2019 (AT) ..... A 49/2019

(51) Int. Cl.
*F25D 17/04* (2006.01)
*F25D 23/08* (2006.01)

(52) U.S. Cl.
CPC ..... *F25D 17/047* (2013.01); *F25D 23/087* (2013.01)

(58) Field of Classification Search
CPC .. F25D 17/047; F25D 23/087; F25D 2400/10; F25D 23/025; F25D 2321/14
See application file for complete search history.

(56) References Cited

U.S. PATENT DOCUMENTS 1,729,081 A 9/1929 Miller
1,729,082 A 9/1929 Miller
(Continued)

FOREIGN PATENT DOCUMENTS

CN 101280991 A * 10/2008
CN 201828099 U * 5/2011
(Continued)

OTHER PUBLICATIONS

International Search Report issued in International Application No. PCT/IB2017/000941 dated Oct. 23, 2017.
(Continued)

*Primary Examiner* — Miguel A Diaz
*Assistant Examiner* — Ibrahim A. Michael Adeniji
(74) *Attorney, Agent, or Firm* — Pillsbury Winthrop Shaw Pittman, LLP

(57) ABSTRACT

In a transport container for transporting temperature-sensitive transport goods, comprising a chamber for receiving the transport goods and a casing which surrounds the chamber and is equipped with a door device, the door device comprises at least one door leaf for closing a door opening of the casing, wherein at least one inner circumferential seal is provided between the at least one door leaf and the door opening and at least one outer circumferential seal is provided between the at least one door leaf and the door opening. The inner and outer seals each comprise at least one sealing element that can be displaced by a pressure difference and that, when a predetermined pressure difference is exceeded, opens an air passage from the outside to the inside or vice versa, wherein a buffer space delimited by the inner and outer seals is arranged and that a temperature control element is provided to cool the buffer space.

17 Claims, 4 Drawing Sheets

(56) References Cited

U.S. PATENT DOCUMENTS

Figure 1:
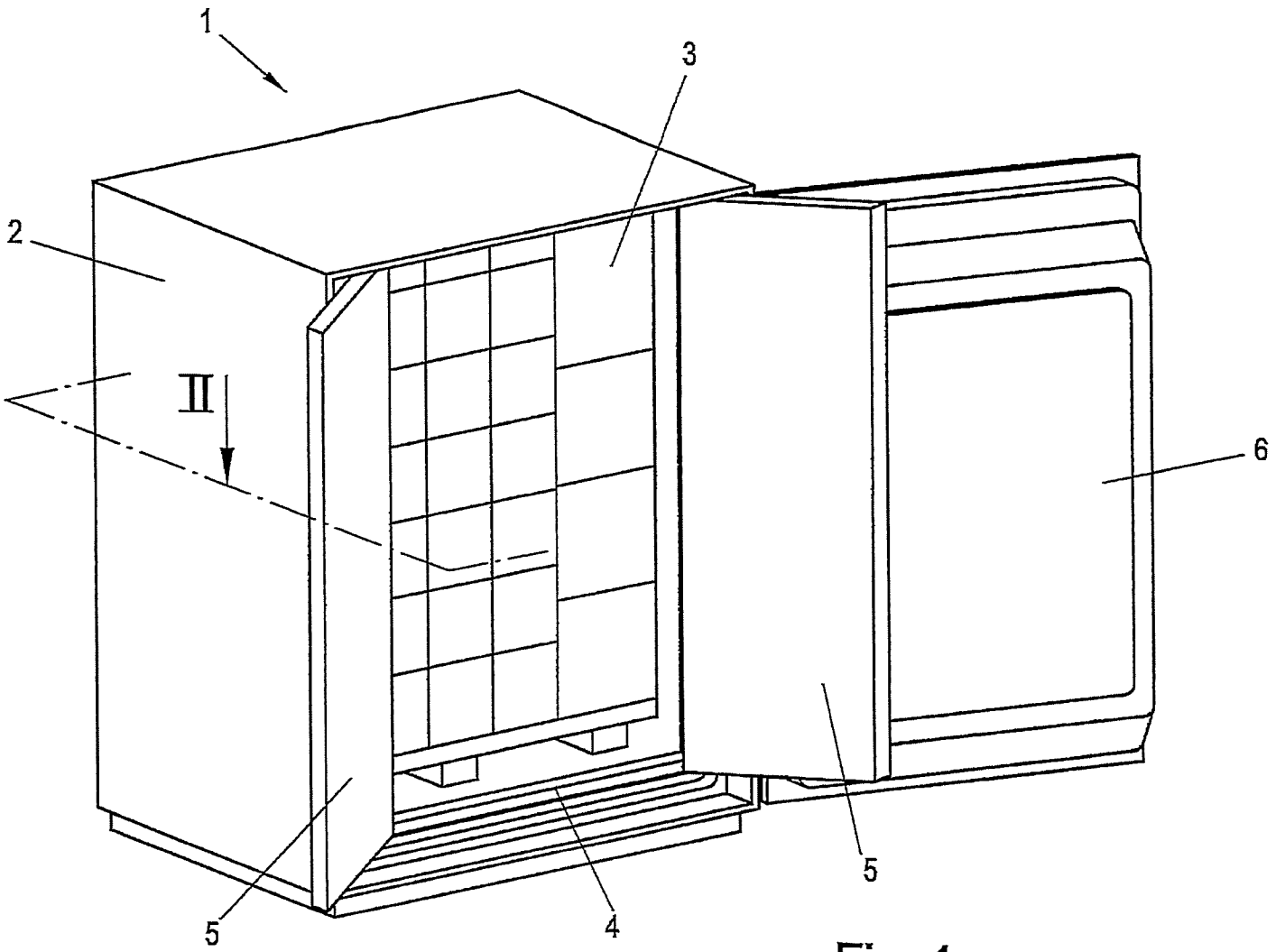

| | | | | |
|---|---|---|---|---|
| 2,480,257 | A | 8/1949 | Palmer et al. | |
| 3,164,869 | A * | 1/1965 | Barkan | F25D 23/082 49/401 |
| 3,240,029 | A | 3/1966 | Wurtz | |
| 4,152,901 | A | 5/1979 | Munters | |
| 4,199,959 | A | 4/1980 | Wurm | |
| 5,363,670 | A * | 11/1994 | Bartilucci | F25D 29/001 62/166 |
| 5,497,630 | A | 3/1996 | Stein et al. | |
| 6,412,295 | B2 | 7/2002 | Weiss | |
| 6,584,797 | B1 * | 7/2003 | Smith | F25D 11/003 62/371 |
| 7,080,485 | B2 * | 7/2006 | Cittadini | F25D 23/082 49/478.1 |
| 7,213,403 | B2 | 5/2007 | Maier-Laxhuber | |
| 7,257,963 | B2 * | 8/2007 | Mayer | C09K 5/063 62/530 |
| 2001/0025510 | A1 | 10/2001 | Maier-Laxhuber et al. | |
| 2002/0189279 | A1 | 12/2002 | Pfister et al. | |
| 2003/0010041 | A1 * | 1/2003 | Wessling | B64G 1/50 62/457.2 |
| 2004/0079106 | A1 | 4/2004 | Maier-Laxhuber | |
| 2009/0039751 | A1 * | 2/2009 | Keller | F25D 17/047 312/405 |
| 2009/0044556 | A1 * | 2/2009 | Ihle | F25D 21/04 62/449 |
| 2009/0301127 | A1 | 12/2009 | Kaufman | |
| 2010/0024439 | A1 | 2/2010 | Finke | |
| 2010/0170286 | A1 | 7/2010 | Ghiraldi | |
| 2011/0271691 | A1 * | 11/2011 | Tuszkiewicz | F25D 17/06 62/3.62 |
| 2012/0097216 | A1 | 4/2012 | Lin | |
| 2013/0152612 | A1 | 6/2013 | Smith | |
| 2014/0202661 | A1 | 7/2014 | Goenka | |
| 2014/0290293 | A1 | 10/2014 | Eckhoff | |
| 2014/0360214 | A1 | 12/2014 | Tansley | |
| 2016/0290696 | A1 | 10/2016 | Barot | |
| 2017/0350635 | A1 * | 12/2017 | Thirumurugavel | F25D 17/00 |
| 2018/0080701 | A1 * | 3/2018 | Langlotz | F25D 21/125 |

FOREIGN PATENT DOCUMENTS

| | | | | |
|---|---|---|---|---|
| CN | 205002492 | U * | 1/2016 | |
| DE | 1262406 | B | 3/1968 | |
| DE | 3412556 | A1 | 10/1985 | |
| DE | 8631174 | U1 | 4/1987 | |
| DE | 102007010981 | A1 | 9/2008 | |
| DE | 202015101481 | U1 | 8/2015 | |
| EP | 0805321 | A1 | 11/1997 | |
| EP | 1416233 | A2 | 5/2004 | |
| EP | 2941984 | A1 * | 11/2015 | F25D 23/10 |
| FR | 2858601 | A1 | 2/2005 | |
| GB | 1395719 | | 5/1975 | |
| JP | 57-24258 | U | 2/1982 | |
| JP | S58-164954 | A | 9/1983 | |
| JP | 60-16280 | A | 1/1985 | |
| JP | 2002-013835 | | 1/2002 | |
| JP | 2002013835 | A | 1/2002 | |
| JP | 2002-107003 | A | 4/2002 | |
| JP | 2005-299974 | A | 10/2005 | |
| KR | 20180001058 | A * | 1/2018 | F25B 41/40 |
| WO | 92/13244 | A1 | 8/1992 | |
| WO | 00/50827 | A1 | 8/2000 | |
| WO | 02/099345 | A1 | 12/2002 | |
| WO | 03/059779 | A1 | 7/2003 | |
| WO | 2011/032299 | A1 | 3/2011 | |
| WO | 2012/062314 | A1 | 5/2012 | |
| WO | 2018/029521 | A1 | 2/2018 | |

OTHER PUBLICATIONS

International Search Report dated Apr. 28, 2020, issued in corresponding International Patent Application No. PCT/IB2020/050742 (5 pgs.).

Office Action dated May 17, 2023, issued in corresponding U.S. Appl. No. 16/324,149 (13 pgs.).

* cited by examiner

TRANSPORT CONTAINER

CROSS-REFERENCE TO RELATED APPLICATIONS

This application is the U.S. national stage entry of PCT/IB2020/050742, filed Jan. 30, 2020, which claims priority to Austrian Patent Application No. A 49/2019, filed Feb. 7, 2019, the contents of both of which are herein incorporated by reference in their entireties.

The invention relates to a transport container for the transport of temperature-sensitive transport goods, comprising a chamber for receiving the transport goods and a casing that surrounds the chamber and is equipped with a door device, wherein the door device comprises at least one door leaf for closing a door opening of the casing, wherein at least one inner circumferential seal is provided between the at least one door leaf and the door opening and at least one outer circumferential seal is provided between the at least one door leaf and the door opening.

When transporting temperature-sensitive goods, such as pharmaceuticals, over periods of several hours or days, specified temperature ranges must be observed during storage and transport in order to ensure the usability and safety of the goods. For various drugs, temperature ranges from 2 to 25° C., in particular 2 to 8° C. or 15 to 25° C., are specified as storage and transport conditions.

Transport containers with special insulation properties are used to ensure that the desired temperature range is permanently and verifiably maintained during transport. These containers are equipped with passive or active temperature control elements.

Active temperature control elements require an external energy supply for their operation. They are based on the conversion of a non-thermal form of energy into a thermal form of energy. The release or absorption of heat takes place, for example, as part of a thermodynamic cycle, such as by means of a vapor-compression refrigeration system.

Another design of active temperature control elements works on the basis of the thermoelectric principle, whereby so-called Peltier elements are used. Because of the complex structure of the active temperature control elements, containers of this type are expensive and relatively large. Furthermore, due to the system, they are dependent on an energy supply. If there is no energy supply, the containers cannot be cooled or heated.

Passive temperature control elements do not require any external energy supply during use, but use their heat storage capacity, with heat being released or absorbed to or from the interior of the transport container to be temperature controlled, depending on the temperature level. However, such passive temperature control elements are exhausted as soon as the temperature equalization with the interior of the transport container has been completed.

A special form of passive temperature control elements are latent heat accumulators that can store thermal energy in phase change materials whose latent heat of fusion, heat of solution or heat of absorption is much greater than the heat that they can store due to their normal specific heat capacity. The disadvantage of latent heat accumulators is the fact that they lose their effect as soon as all of the material has completely passed through the phase change. However, by executing the opposite phase change, the latent heat storage can be recharged.

When transporting transport containers by air freight, transport containers must enable pressure equalization between the interior of the transport container and the pressurized cabin of the aircraft, especially since the cabin pressure in the passenger cabin and in the cargo hold is set lower than the ambient air pressure during take-off and landing. For pressure equalization, transport containers are usually equipped with a valve or a door seal, which allows an air flow from the container chamber to the outside (when climbing) or from the outside into the container chamber (when descending) when a specified differential pressure between the environment and the container chamber is exceeded. In the latter case, however, warm ambient air reaches the interior of the container with the air flow, which has a significantly colder temperature compared to the surroundings, so that the dew point may be fallen below and water may condense from the air. The occurrence of condensate in the container chamber is undesirable because it affects the transported goods.

The present invention is therefore aimed at developing a transport container of the type mentioned at the outset in such a way that the occurrence of condensate in the container chamber can be reliably avoided.

To achieve this object, the invention essentially consists in a transport container of the type mentioned at the outset wherein the inner and outer seals each comprise at least one sealing element which can be displaced by a pressure difference and which opens an air passage from the outside to the inside or vice versa when a predetermined pressure difference is exceeded, wherein a buffer space delimited by the inner and the outer seal is arranged and wherein a temperature control element is provided in order to cool the buffer space.

The invention is thus based on the idea of cooling the air entering from the environment due to pressure equalization before it reaches the interior of the container chamber. For this purpose, a buffer space is created which is formed between the outer and the inner circumferential seal and into which the ambient air flows before it reaches the container chamber. A temperature control element ensures that the buffer space is cooled. Due to the precooling of the ambient air, drying also takes place, with any condensate accumulating along the flow path of the air upstream of the container chamber and in particular in the buffer space, but in any case not in the container chamber itself.

The air flowing in from the environment during pressure equalization passes the outer circumferential seal between the at least one door leaf and the door opening, this seal comprising at least one sealing element that can be displaced by a pressure difference, so that when a predetermined pressure difference is exceeded, the ambient air can flow inward into the buffer space. The buffer space forms a buffer in which the air is pre-cooled and any condensate is collected. When the pressure is equalized, the pre-cooled air passes the at least one inner circumferential seal between the at least one door leaf and the door opening, so that the pre-cooled air enters the container chamber.

Because air is only allowed to pass if a predetermined pressure difference is exceeded, the amount of air flowing in can be kept so low that the heat transfer, required for pre-cooling the air, from the air to the components delimiting the buffer space or to the temperature control element is ensured. The at least one sealing element is preferably designed in such a way that it allows air to pass through at a pressure difference of 200-300 mbar.

With regard to the circumferential configuration of the at least one inner and the at least one outer seal, according to a preferred embodiment, the buffer space arranged between the inner and the outer seal is designed to be annular. The ambient air can therefore flow into the buffer space from all sides.

In particular, it is provided here that the buffer space is delimited by the at least one door leaf and by a surface of the casing that forms the door opening.

Furthermore, it is preferably provided that the temperature control element is arranged in the region of the casing facing the buffer space in order to cool the outer surface of the casing delimiting the buffer space. This makes it possible to use a temperature control element arranged in the casing, which is originally intended for temperature control of the chamber, for temperature control of the buffer space.

According to a preferred embodiment, the door device is double-walled and comprises at least one inner door leaf and at least one outer door leaf to close the door opening of the casing, wherein the at least one inner circumferential seal is provided between the at least one inner door leaf and the door opening and the at least one outer circumferential seal is provided between the at least one outer door leaf and the door opening, and wherein the buffer space is arranged between the at least one inner door leaf and the at least one outer door leaf. In this embodiment, the buffer space is thus arranged in a double wall structure of the door device and comprises an intermediate space between an outer and an inner door leaf of the door device. As a result, the volume of the buffer space can be maximized without having to significantly enlarge the overall transport container. In particular, a larger area is available for temperature control of the buffer space, namely preferably the inner surface of the outer door leaf facing the buffer space and/or the outer surface of the outer door leaf facing the buffer space.

The outer and inner door leaves can preferably be opened and closed separately, i.e. first the outer door leaf and then the inner door leaf must be opened in order to get into the container chamber. Alternatively, the design can also be made such that the outer and the inner door leaf can be opened and closed together. In particular, the outer and the inner door leaf can form two layers of a door, between which the said buffer space is provided.

According to a preferred embodiment, it is provided that the at least one inner door leaf comprises the temperature control element, which is designed to cool the outer surface of the at least one inner door leaf facing the buffer space. The temperature control element can in this case be arranged in the inner door leaf, the heat transfer to the buffer space being able to take place over the correspondingly large area of the door leaf. The temperature control element used for cooling the buffer space can preferably be the same temperature control element that is also used for temperature control of the container chamber. In this way, a particularly energy-efficient structure is achieved in which hardly any additional energy is required for cooling the buffer space.

The temperature control element is preferably designed to keep the buffer space or the outer surface of the at least one inner door leaf facing the buffer space at a temperature that is at most 5-10° C. above, preferably at most 2-5° C. above the temperature of the chamber. This effectively prevents condensation in the container chamber. The temperature of the container chamber is kept, for example, at 2 to 8° C. or 15 to 25° C., the buffer space having the same or a slightly higher temperature.

The temperature control element is preferably designed as a cooling element, an embodiment as an active or a passive cooling element being possible.

The temperature control element particularly preferably comprises a latent heat accumulator, i.e. an element that stores thermal energy in a phase change material whose latent heat of fusion, heat of solution or heat of absorption is significantly greater than the heat that it can store due to its normal specific heat capacity. Paraffin, for example n-tetradecane or n-hexadecane, esters, for example methyl esters, linear alcohols, ethers, organic anhydrides, salt hydrates, water-salt mixtures and/or salt solutions come into consideration as phase change material. Preferred phase change materials include paraffins and salt mixtures, such as, for example, RT5 from Rubitherm or paraffins from Sasol.

It is preferably provided here that the phase change material has a phase transition temperature of 3-10° C., in particular approx. 5° C. A transport container with a latent heat accumulator having such a phase change material can be used particularly well for the transport of medicaments.

The latent heat accumulator can preferably be designed as a plate-shaped element. An advantageous embodiment results when the plate-shaped element has a plurality of, in particular, honeycomb-shaped hollow chambers which are filled with the latent heat storage material, a honeycomb structure element according to WO 2011/032299 A1 being particularly advantageous.

Alternatively, it can be provided that the temperature control element is designed as an active temperature control element and preferably comprises a vapor-compression refrigeration system or a Peltier element.

Furthermore, it can be provided that the temperature control element has an evaporative cooling system, including

- an evaporation element with a cooling surface,
- a desiccant to absorb coolant that has evaporated in the evaporation element,
- a transport path for transporting the evaporated coolant to the desiccant,
- possibly a storage chamber for the coolant that can be brought into fluid connection with the evaporation element.

The temperature control element preferably comprises both a latent heat accumulator and an evaporative cooling system. The combination of two different cooling systems, namely an evaporative cooling system with a latent heat accumulator, has a number of advantages. The performance of the evaporative cooling system can be reduced so that it can be made smaller and with less weight. The total cooling capacity can be divided between the evaporative cooling system and the latent heat accumulator. The cooling system can be designed so that when the performance of the evaporative cooling system is no longer sufficient and the temperature of the chamber increases, the additional cooling performance is drawn from the latent heat accumulator device, which requires energy for the phase transition from solid to liquid.

The cooling system can preferably be designed in such a way that the phase transition temperature (solid to liquid) of the latent heat accumulator is selected to be lower than the temperature resulting from the cooling capacity of the evaporative cooling system. With the evaporative cooling system, the temperature of the chamber and/or the buffer space can preferably be reduced to a temperature of 12-20° C., further cooling to a temperature in the range of 2-8° C. being carried out with the aid of the latent heat accumulator. This combination allows the desiccant of the evaporative cooling system to work with a higher relative humidity, which means that the amount of desiccant can be reduced. The amount of latent heat accumulator can also be reduced, since it only has to provide the energy for cooling from the range of 12-20° C. to the range of 2-8° C.

Another advantage is that with a partially charged (i.e. not completely crystallized) latent heat accumulator, this can be used to protect the chamber against hypothermia or to keep it within the desired temperature range of e.g. 2-8° C. if the outside temperature drops below the level of the desired temperature range.

In a preferred embodiment, in which the goods to be transported in the chamber are to be kept in a temperature range of 2-8° C., the latent heat accumulator is designed with a phase transition temperature of approx. 4-6° C.

If the transport container is stored in a cold store for a long time (e.g. several days) (e.g. in a customs warehouse), e.g. at a temperature of 2-8° C., and the evaporative cooling system is set to a cooling capacity to achieve a temperature above the temperature in the cold store, the evaporative cooling system is not active during the storage period, so that no coolant is consumed. Furthermore, the period of storage can be used to charge the latent heat accumulator, which happens automatically in the cold store at a temperature of, for example, below 6° C. if the phase transition temperature of the latent heat accumulator is accordingly 6° C. As a result, with a minimal design of the two systems (latent heat accumulator and evaporative cooling system), a longer usage or transport duration of the transport container can be achieved than if only one cooling system were used alone.

Another advantage arises when the evaporative cooling system provides more cooling power than is required. The excess cooling power can then be used to recharge the latent heat accumulator, i.e. to return it to the solid or crystallized state.

In order to improve the sealing of the door device, it can be provided that at least two outer seals are provided, one behind the other and at a distance from one another in the direction of an air flow from the outside into the buffer space, wherein each of said two outer seals comprises a sealing element that is displaceable by a pressure difference and that opens an air passage from the outside into the buffer space when a predetermined pressure difference is exceeded. The provision of at least two cascading outer seals has the additional effect that a further buffer volume is created between the first and the second outer seal for the air flowing from the surroundings into the buffer space when the pressure is equalized. It is particularly preferable for three seals to be provided one behind the other.

The outer door leaf can also be equipped with a temperature control element. In particular, it can be provided that the at least one outer door leaf comprises a layer with a latent heat accumulator.

Alternatively or additionally, the at least one outer door leaf can comprise a thermal insulation layer.

In terms of construction, the sealing element of the outer and/or inner seal can be designed to enable pressure equalization in such a way that it is designed as an elastically deflectable sealing lip of the seal. The sealing lip can preferably be formed in one piece with the seal.

The inner and/or outer seal can be attached to the at least one door leaf, preferably to the inner or outer door leaf, or also to the door opening, wherein in each case a circumferential arrangement of the seal is advantageous in order to ensure that the door device is sealed on all sides. If the seal is attached to the at least one door leaf and, as is basically conceivable, two door leaves are provided which can be pivoted in opposite directions in the sense of a double-leaf door, each door leaf is provided with a circumferential seal.

In an embodiment with two outer seals arranged one behind the other, it is preferably provided that one of the two outer seals is fastened to the outer door leaf and the other of the two outer seals is fastened to the door opening.

In order to collect any condensate that may accumulate in the buffer space, it is preferably provided that the buffer space has a collecting chamber for condensate or is connected to it.

The invention is explained in more detail below with reference to an exemplary embodiment shown schematically in the drawing. Therein, FIG. 1 shows a perspective view of a cuboid transport container in a first embodiment with the doors open, FIG. 2 shows a cross section of the transport container along plane II of FIG. 1, FIG. 3 shows a detailed view of the cross section according to FIG. 2 and FIG. 4 shows a cross section of the transport container analogous to FIG. 2, but in a modified embodiment.

In FIG. 1, a transport container 1 is shown, which is cuboid and whose casing 2 surrounds a container chamber 3 on five sides. On the sixth side, the casing 2 has a door opening 4 which can be closed with an inner door and an outer door. The inner door comprises two inner door leaves 5, which can be pivoted open in opposite directions in the manner of a double wing door. The outer door comprises an outer door leaf 6. The casing 2, the inner door leaves 5 and the outer door leaf 6 comprise heat-insulating material and temperature control elements which ensure that the container chamber 3 remains at a predetermined temperature level of, for example, 2-8° C. or 15-25° C.

Figure 2:
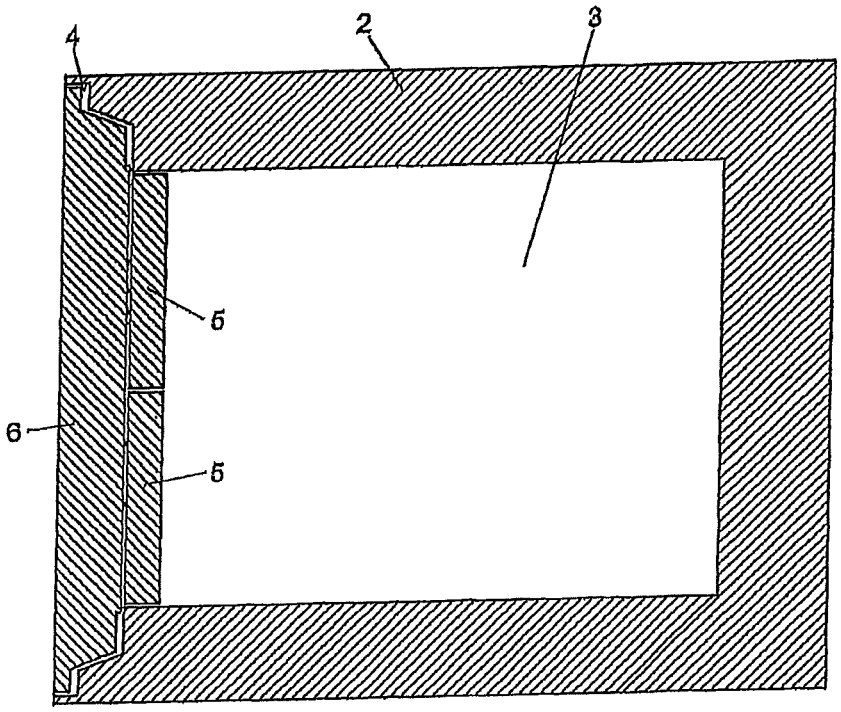

In the cross-sectional view according to FIG. 2, the door leaves 5 and 6 are shown closed and completely close the door opening.

Figure 3:
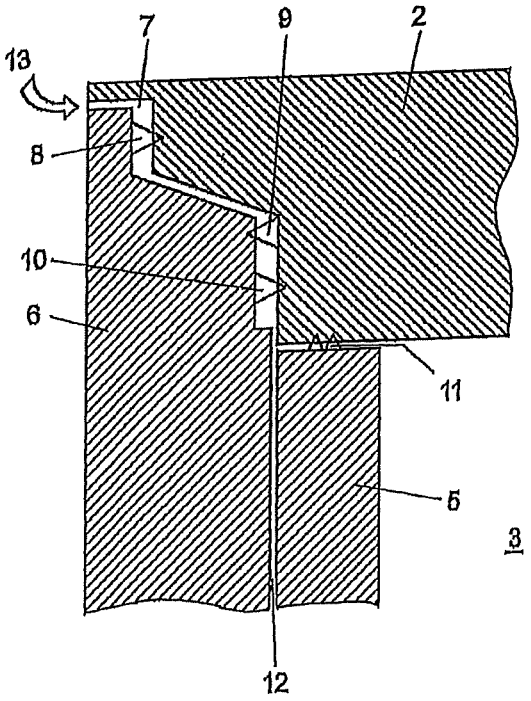
Figure 4:
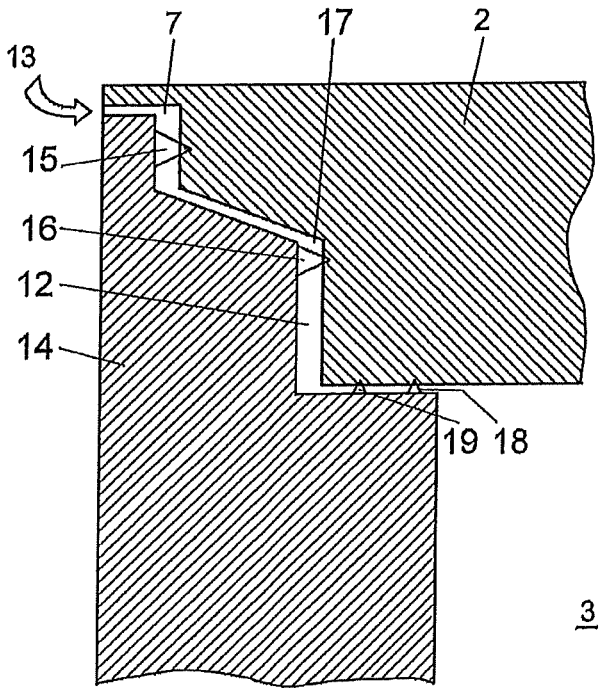

In the detailed view according to FIG. 3, the sealing of the gap 7 between the door device and the casing 2 is shown. A first outer circumferential seal 8 is provided between the outer door leaf 6 and the casing 2 and is fastened to an outer circumferential edge section of the door leaf 6, which is formed with a smaller thickness. Further inward, a second and a third outer seals 9 and 10 are provided between the outer door leaf 16 and the casing 2, which are also formed circumferentially and provide additional sealing. The second outer seal 9 is attached to the casing 2 and the third outer seal 10 is attached to the door leaf 6. The seals 8, 9 and 10 are each arranged at the front face so that they are compressed by the closing movement of the door leaf 6.

Between the inner door leaf 5 and the casing 2, an inner seal 11 is arranged which is attached to the narrow side of the door leaf 5 and surrounds the door leaf 5 circumferentially.

The gap 7 leads into an intermediate space 12 which is formed between the two parallel door leaves 5 and 6. If there is a pressure difference between the container chamber 3 and the environment, the seals 8, 9, 10 and 11 are deformed in such a way that pressure equalization can take place and a certain amount of air 13 can pass through the gap 7 into the intermediate or buffer space 12 and the container chamber 3. The buffer space 12 serves as a buffer space in which a volume of air is kept in stock and precooled by means of a temperature control element (not shown), the temperature control element preferably being arranged in the inner door leaf 5 in order to cool the buffer space 12 via the outer surface of the door leaf 5 facing the buffer space. The air in the buffer space 12 is thereby cooled to a temperature that corresponds to the temperature prevailing in the container chamber 3 or a temperature slightly above it, whereby any condensation of water takes place in the buffer space 12 before this air enters the container chamber 3.

In the alternative embodiment according to FIG. 4, the door device is not double-walled with an intermediate space, but only comprises the door leaf 14 or, in the case of a double-wing door, two door leaves 14. A first outer circumferential seal 15 is provided between the door leaf 14 and the casing 2 and is fastened to an outer, circumferential edge section of the door leaf 14, which is formed with a smaller thickness. Further inward, a second outer seal 16 is provided between the door leaf 14 and the casing 2, which is also formed circumferentially and provides an additional seal. The seals 15 and 16 are each arranged at the front face so that they are compressed by the closing movement of the door leaf 14 in the closing direction.

Furthermore, an inner seal 18 is arranged between the door leaf 14 and the casing 2, which is attached to the narrow side of the door leaf 14 and surrounds the door leaf 14 circumferentially. In addition to the inner seal 18, a second inner seal 19 can optionally be arranged.

The gap 7 leads into a first space 17 which is formed between the two outer seals 15 and 16. The buffer space 12, which is delimited on the inside by the inner seal 18 and possibly 19, adjoins the first space 17 inwardly towards the chamber 3. If there is a pressure difference between the container chamber 3 and the environment, the seals 15, 16, 18 and possibly 19 are deformed so that a pressure equalization takes place and a certain amount of air 13 can get through the gap 7 into the first space 17, an equivalent amount of air can get from the first space 17 into the buffer space 12 and an equivalent amount of air can get from the buffer space into the container chamber 3. The buffer space 12 serves as a buffer in which a volume of air is kept in stock and precooled by means of a temperature control element (not shown), the temperature control element preferably being arranged in the casing 2. If necessary, a partial temperature control or cooling of the air can already take place in the first room 17, so that only the remaining temperature control or cooling has to take place in the subsequent buffer room 12.

The invention claimed is:

1. A transport container for transporting temperature-sensitive transport goods, comprising a chamber for receiving the transport goods and a casing which surrounds the chamber and is equipped with a door device, wherein the door device comprises at least one door leaf for closing a door opening of the casing, said door opening providing access to the chamber, wherein at least one inner circumferential seal is provided between the at least one door leaf and the door opening and arranged to seal the door device against the door opening, and wherein at least one outer circumferential seal is provided between the at least one door leaf and the door opening and arranged to seal the door device against the door opening, wherein the at least one inner and outer circumferential seals each comprise at least one sealing element that can be displaced by a pressure difference and that, when a predetermined pressure difference is exceeded, opens an air passage from the outside to the inside or vice versa, wherein a buffer space delimited by the at least one inner and outer circumferential seals is arranged and the air passage opens through the buffer space by displacement of the sealing elements of the at least one inner and outer circumferential seals and that a temperature control element is provided to cool the buffer space.

2. The transport container according to claim 1, characterized in that the buffer space is annularly delimited between the at least one inner and outer circumferential seals.

3. The transport container according to claim 2, characterized in that the buffer space is delimited by the at least one door leaf and by a surface of the casing forming the door opening.

4. The transport container according to claim 1, characterized in that the temperature control element is arranged in the region of the casing facing the buffer space in order to cool the outer surface of the casing, which outer surface is delimiting the buffer space.

5. The transport container according to claim 1, characterized in that the door device is double-walled and comprises at least one inner door leaf and at least one outer door leaf for closing the door opening of the casing, wherein the at least one inner circumferential seal is provided between the at least one inner door leaf and the door opening and the at least one outer circumferential seal is provided between the at least one outer door leaf and the door opening, and wherein the buffer space is arranged between the at least one inner door leaf and the at least one outer door leaf.

6. The transport container according to claim 5, characterized in that the at least one inner door leaf comprises the temperature control element which is designed to cool the outer surface of the at least one inner door leaf facing the buffer space.

7. The transport container according to claim 5, characterized in that the temperature control element is designed to keep the buffer space or the outer surface of the at least one inner door leaf facing the buffer space at a temperature that is at most 2-10° C. above a temperature of the chamber.

8. The transport container according to claim 1, characterized in that the temperature control element is designed as a cooling element.

9. The transport container according to claim 1, characterized in that the temperature control element comprises a latent heat storage.

10. The transport container according to claim 1, characterized in that the temperature control element is designed as an active temperature control element and comprises a vapor-compression refrigeration system or a Peltier element.

11. The transport container according to claim 1, characterized in that the temperature control element comprises an evaporative cooling system, comprising an evaporation element with a cooling surface, a desiccant to absorb coolant that has evaporated in the evaporation element, a transport path for transporting the coolant to the desiccant, and a storage chamber for the coolant that can be brought into fluid connection with the evaporation element.

12. The transport container according to claim 1, characterized in that at least two outer circumferential seals are provided, one behind the other and at a distance from one another in the direction of an air flow from the outside into the buffer space, wherein each of said at least two outer circumferential seals comprises a sealing element that is displaceable by a pressure difference and that opens an air passage from the outside into the buffer space when a predetermined pressure difference is exceeded.

13. The transport container according to claim 1, characterized in that the at least one door leaf comprises a layer with a latent heat storage.

14. The transport container according to claim 1, characterized in that the at least one door leaf comprises a thermal insulation layer.

15. The transport container according to claim 1, characterized in that the sealing element is designed as a sealing lip with elastic properties.

16. The transport container according to claim 1, characterized in that the buffer space comprises a collecting chamber for condensate or is connected to the same.

17. The transport container according to claim 1, wherein each of the at least one sealing elements are different from the casing.

* * * * *